US008196519B2

(12) United States Patent
Kumar et al.

(10) Patent No.: US 8,196,519 B2
(45) **Date of Patent: *Jun. 12, 2012**

(54) VEHICLE SUSPENSION CONTROL SYSTEM AND METHOD

(75) Inventors: Ajith Kuttannair Kumar, Erie, PA (US); Bret Worden, Erie, PA (US); Jeremy Thomas McGarry, Erie, PA (US)

(73) Assignee: General Electric Company, Schenectady, NY (US)

( * ) Notice: Subject to any disclaimer, the term of this patent is extended or adjusted under 35 U.S.C. 154(b) by 282 days.

This patent is subject to a terminal disclaimer.

(21) Appl. No.: 12/574,914

(22) Filed: Oct. 7, 2009

(65) Prior Publication Data

US 2011/0079168 A1 Apr. 7, 2011

(51) Int. Cl.
*B61C 15/04* (2006.01)

(52) U.S. Cl. ..... 105/75; 105/73; 105/209; 105/194

(58) Field of Classification Search ..... 105/26.05, 105/33, 34.1, 34.2, 73, 75, 78, 82, 96, 194, 105/209; 318/52; 701/19
See application file for complete search history.

(56) References Cited

U.S. PATENT DOCUMENTS

| | | | | |
|---|---|---|---|---|
| 598,403 | A | 2/1898 | Uebelacker | |
| 882,618 | A * | 3/1908 | Bothwell | 105/33 |
| 1,020,607 | A | 3/1912 | Hunt | |
| 2,016,626 | A * | 10/1935 | Constantinesco | 105/72.2 |
| 2,128,066 | A * | 8/1938 | Alben | 105/75 |
| 2,709,968 | A * | 6/1955 | Cox | 105/75 |
| 6,028,402 | A * | 2/2000 | Kumar et al. | 318/52 |
| 2005/0251299 | A1 | 11/2005 | Donnelly et al. | |
| 2007/0001629 | A1 | 1/2007 | McGarry et al. | |
| 2009/0031915 | A1 * | 2/2009 | Kumar et al. | 105/34.1 |
| 2009/0031916 | A1 * | 2/2009 | Kumar et al. | 105/34.1 |
| 2009/0031917 | A1 * | 2/2009 | Kumar et al. | 105/35 |
| 2009/0095194 | A1 * | 4/2009 | Kumar et al. | 105/73 |
| 2009/0095195 | A1 * | 4/2009 | Kumar et al. | 105/96 |
| 2009/0095196 | A1 * | 4/2009 | Kumar et al. | 105/96 |
| 2009/0095197 | A1 * | 4/2009 | Kumar et al. | 105/96 |
| 2009/0099714 | A1 * | 4/2009 | Kumar et al. | 701/19 |

(Continued)

FOREIGN PATENT DOCUMENTS

DE 1 035 681 8/1958

(Continued)

OTHER PUBLICATIONS

Kumar, Ajith K. et al., "Vehicle Suspension Control System and Method," U.S. Appl. No. 12/574,929, filed Oct. 7, 2009, 56 pages.

(Continued)

*Primary Examiner* — S. Joseph Morano
*Assistant Examiner* — Zachary Kuhfuss
(74) *Attorney, Agent, or Firm* — Shawn McClintic; Alleman Hall McCoy Russell & Tuttle LLP

(57) ABSTRACT

Methods and systems are provided for a vehicle having a plurality of axles and a lift mechanism configured to dynamically transfer weight from one axle to another. In one example, the method comprises, responding to an operating condition by adjusting the lift mechanism to provide a determined amount of lift, and in response to vehicle braking, a vehicle stall risk, poor infrastructure conditions, and/or a high vehicle penalty, reducing the determined amount of lift.

19 Claims, 9 Drawing Sheets

U.S. PATENT DOCUMENTS

| | | | | |
|---|---|---|---|---|
| 2010/0170413 | A1* | 7/2010 | Kumar et al. | 105/34.1 |
| 2010/0319567 | A1* | 12/2010 | Kumar et al. | 105/34.1 |
| 2010/0319568 | A1* | 12/2010 | Kumar et al. | 105/73 |

FOREIGN PATENT DOCUMENTS

| | | |
|---|---|---|
| EP | 0 779 194 | 6/1997 |
| FR | 1 279 890 | 12/1961 |
| FR | 1 289 653 | 4/1962 |
| FR | 2 430 880 | 2/1980 |
| GB | 562542 | 7/1944 |
| GB | 1116012 | 6/1968 |
| JP | 2006137238 | 6/2006 |
| RU | 2 007 316 | 2/1994 |
| SU | 1525056 | 11/1989 |
| WO | 9713653 | 4/1997 |

OTHER PUBLICATIONS

ISA European Patent Office, International Search Report of PCT/US2008/066253, Sep. 19, 2008, WIPO, 5 pages.
ISA European Patent Office, International Search Report of PCT/US2008/066259, Sep. 30, 2008, WIPO, 5 pages.
ISA European Patent Office, International Search Report of PCT/US2008/066282, Sep. 29, 2008, WIPO, 5 pages.
ISA European Patent Office, International Search Report of PCT/US2008/079540, Jan. 23, 2009, WIPO, 4 pages.

* cited by examiner

700

710

| Operating area | Lift options |
|---|---|
| 701 | Lift sail-start-run<br>Hold |
| 702 | Lift sail-start-run<br>Hold |
| 703 | Lift run<br>Hold |
| 704 | Lift start<br>Hold |
| 705 | Lift run-run<br>Hold |
| 706 | Lift run-run<br>Hold<br>Decrease |
| 707 | Lift run<br>Hold<br>Decrease |
| 708 | Hold<br>Decrease |

VEHICLE SUSPENSION CONTROL SYSTEM AND METHOD

FIELD

The subject matter disclosed herein relates to a method and system for controlling a lift mechanism in a vehicle.

BACKGROUND

Vehicles, such as diesel-electric locomotives, may be configured with truck assemblies including two trucks per assembly, and three axles per truck. The three axles may include at least one powered axle and at least one non-powered axle. The axles may be mounted to the truck via lift mechanisms (such as, suspension assemblies including one or more springs) for adjusting a distribution of locomotive weight (including a locomotive body weight and a locomotive truck weight) between the axles. Weight distribution among the powered and non-powered axles may be performed statically and/or dynamically by adjusting a lift command. Under some operating conditions, while the commanded lift may be technically achievable, it may however adversely affect the locomotive or rail or other infrastructure. For example, a lift commanded in the presence of vehicle friction braking may lead to increased stress on locomotive components such as the brake linkage or the wheels and axles, thereby reducing the useful life of the components and reducing the performance of the system. Similarly, a lift commanded in response to wheel slip but before an effective locomotive sanding operation may be unnecessary. As such, this may lead to potential issues arising from the additional stress generated on the slipping axle, slipping wheel, and lift mechanism components.

BRIEF DESCRIPTION OF THE INVENTION

Systems and methods for a vehicle having a truck with a plurality of axles and a lift mechanism configured to dynamically transfer weight from one axle to another are provided. The method may comprise responding to an operating condition by adjusting the lift mechanism to provide a determined amount of lift; and in response to other dynamic factors, such as locomotive stress conditions, stall risks, infrastructure conditions, and/or vehicle braking, further adjusting the determined amount of lift. In one embodiment, the method comprises responding to an operating condition by adjusting the lift mechanism to provide a determined amount of lift, and in response to vehicle braking, reducing the determined amount of lift. In another embodiment, the method comprises, in response to the identification of a vehicle stall risk, increasing the determined amount of lift. In still another embodiment, the method comprises, in response to an infrastructure condition, reducing the determined amount of lift. In yet another embodiment, the method comprises limiting the determined amount of lift based on a determined vehicle penalty.

In this way, it may be possible to provide lift command adjustments that account for the above interactions and thereby better control dynamic vehicle weight redistribution while achieving high system component life.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

Vehicles, such as locomotives, may be configured with truck assemblies including lift mechanisms (such as, suspension systems) for transferring weight among wheels and/or axles supporting the locomotive. One example of such a mechanism is illustrated with reference to FIGS. 1-3. The mechanism enables dynamic weight management (DWM), and thus enables the weight of the locomotive to be selectively, and dynamically, redistributed among powered and un-powered axles responsive to vehicle operating conditions. For example, during a "DWM lift", such a lift mechanism permits a tractive force (from the locomotive on to the rail) to be increased by distributing a supported load from an un-powered to a powered axle when traction is desired. Likewise, during a "DWM de-lift" (herein, also referred to as a reduction in DWM lift), such a mechanism permits the supported load to be more evenly distributed among the powered and un-powered axles when less traction is desired.

Figure 6:
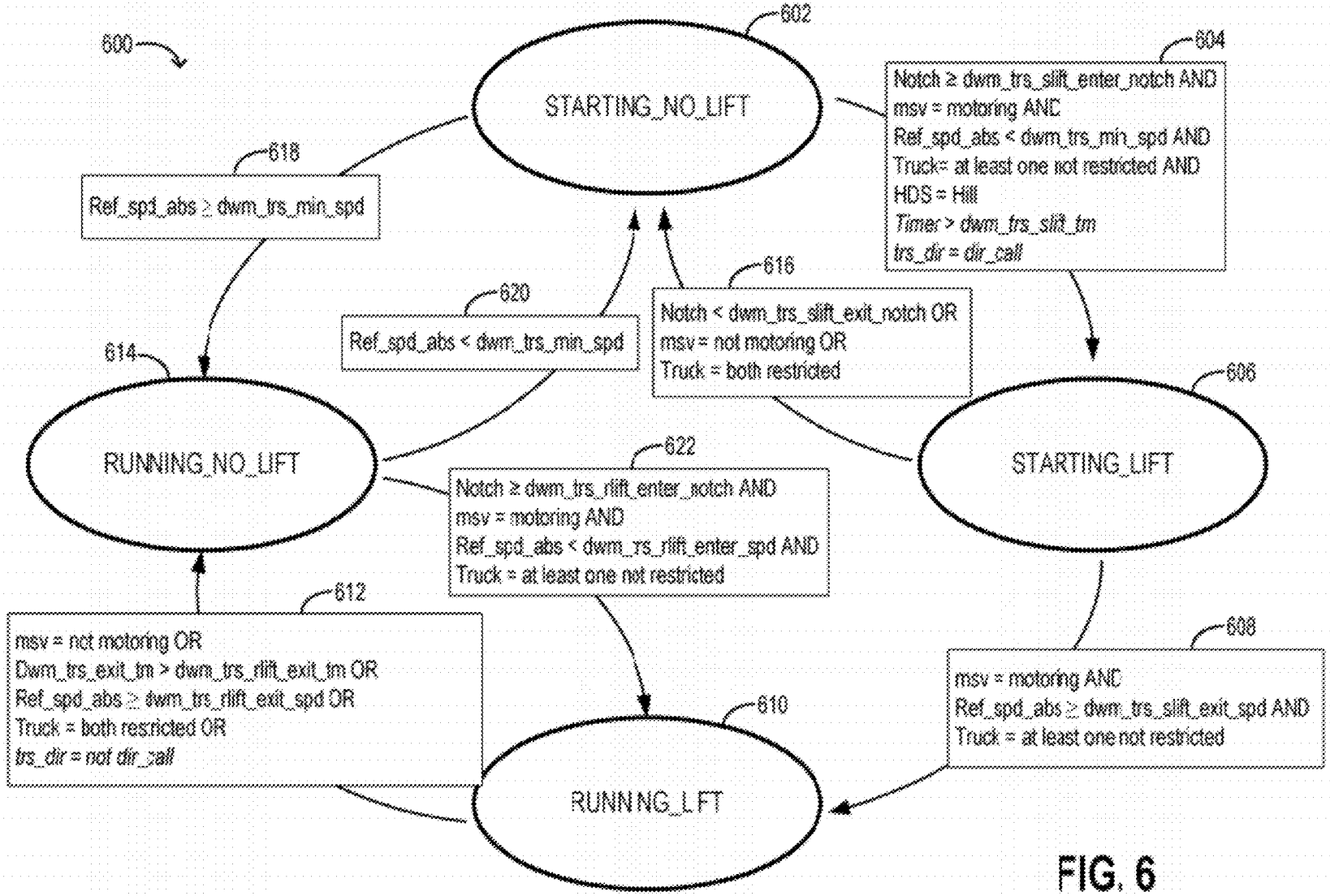
FIG. 6 shows a state diagram for identifying a lift condition in the vehicle lift mechanism.
Figure 7:
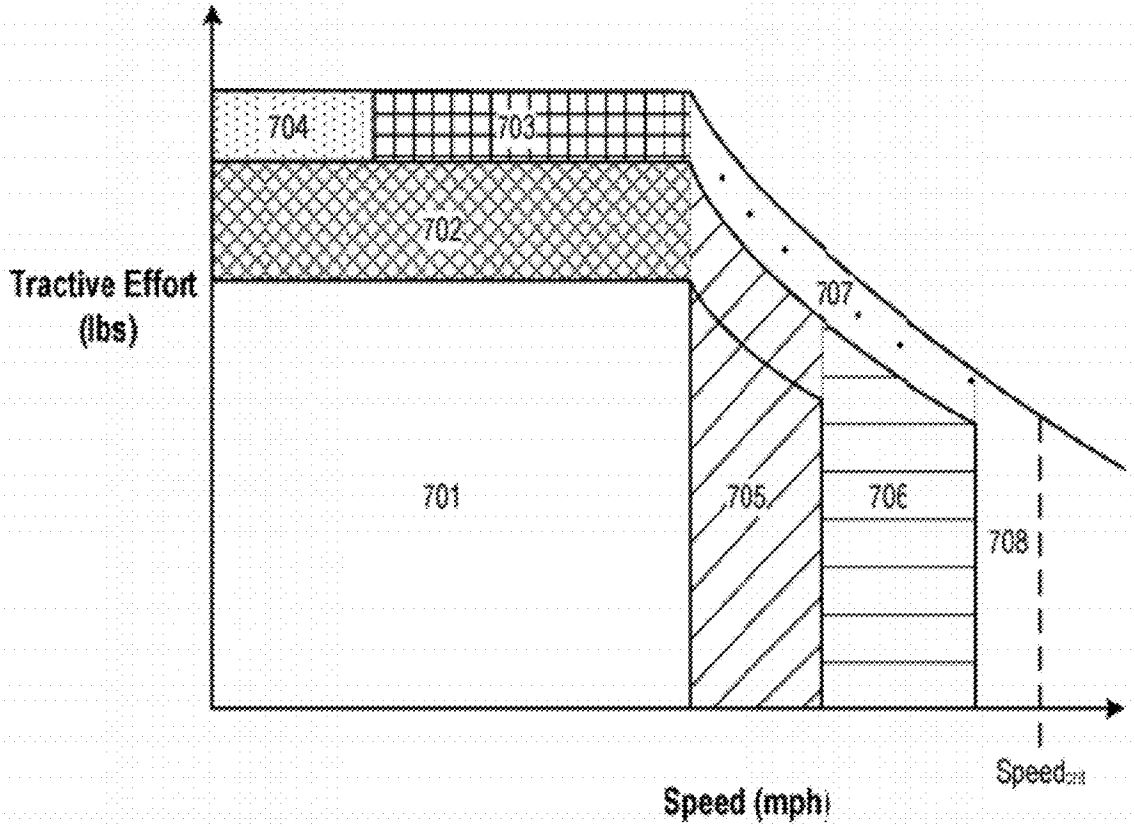
FIG. 7 shows an example map for identifying an operating area of the vehicle.
Figure 8:
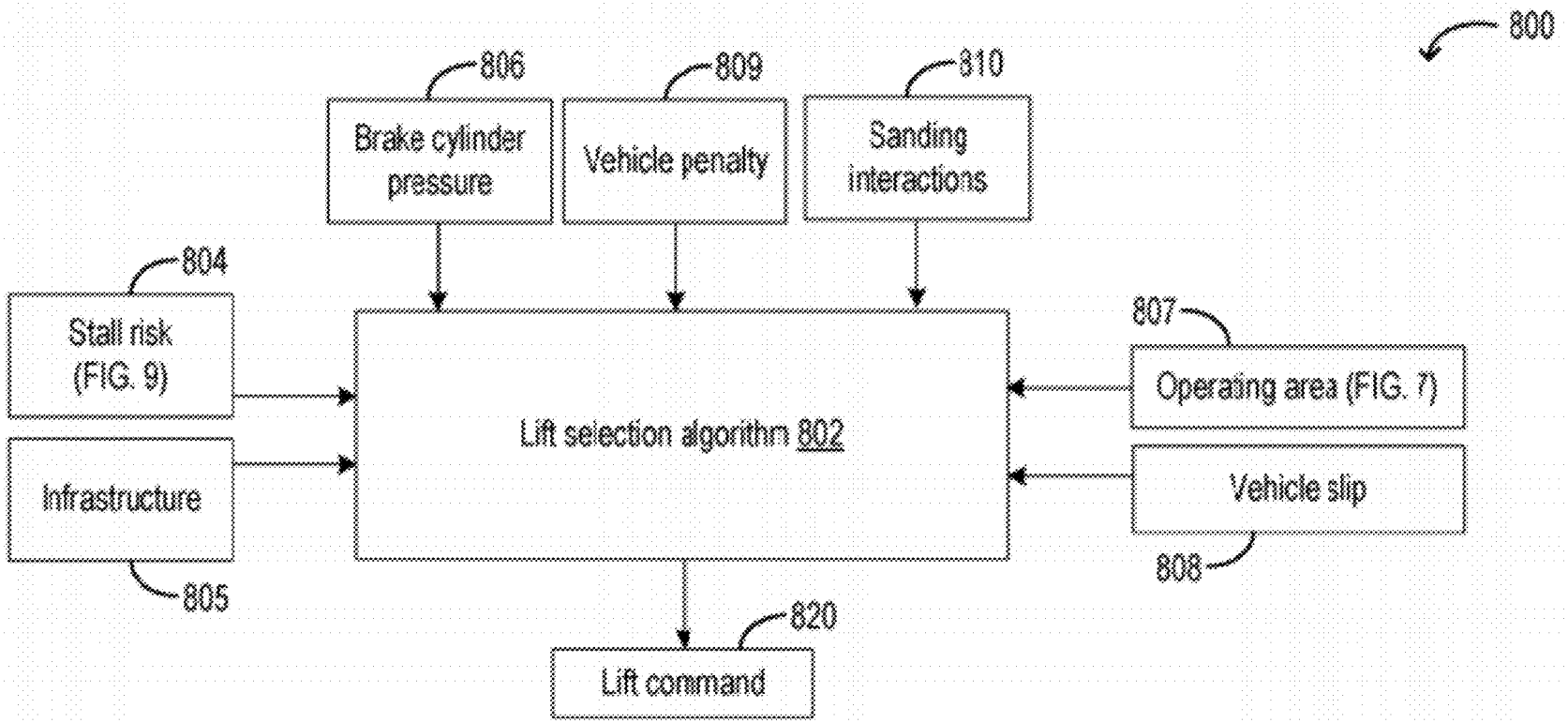
FIG. 8 shows a schematic diagram of an embodiment of a vehicle lift mechanism control system for determining a lift command according to the present disclosure.

As illustrated with reference to FIG. 4, a vehicle control system may be configured to adjust the DWM by adjusting the lift mechanism actuators to provide a determined amount of lift based on vehicle operating conditions. As shown in FIGS. 6-8, the control system may determine whether the vehicle operating conditions permit a lift adjustment, and if so, a nature of lift adjustment (for example, an increase in lift, a decrease in lift, or a hold in lift) based on the position of the vehicle on an operating area map (FIG. 7). While determining the lift command, a controller may take into consideration various operating parameters, such as slipping and sanding interactions, the potential risk of a vehicle stall (FIG. 9), infrastructure conditions (such as the condition of the track on which the vehicle is travelling), etc. When the control system determines that the vehicle operating conditions are not favorable for a lift to be performed, for example in the event of vehicle braking or in case of an emergency air brake application, the controller may be further configured to reduce the lift and/or override the lift command and perform a dump operation (FIG. 5), thereby pre-empting potential lift command related issues.

In this way, by adjusting the amount of lift commanded to a locomotive lift mechanism, the tractive force and weight applied on the rail may be adjusted dynamically responsive to locomotive operating conditions. By dynamically redistributing the locomotive load between powered and unpowered axles, it may be possible to reduce the stress of the lift mechanism during increased traction. Likewise, it may be possible to operate the lift mechanism with a more even loading of the axles to provide a smoother ride and reduce frame and rail stresses at higher vehicle speeds. By further reducing the lift command during operating conditions (such as during air braking), where the commanded lift may degrade locomotive operation (for example, by increasing stress on locomotive components, by reducing air brake effectiveness, by increasing wheel slide, etc.), the useful life of the locomotive components may be increased.

Figure 1:
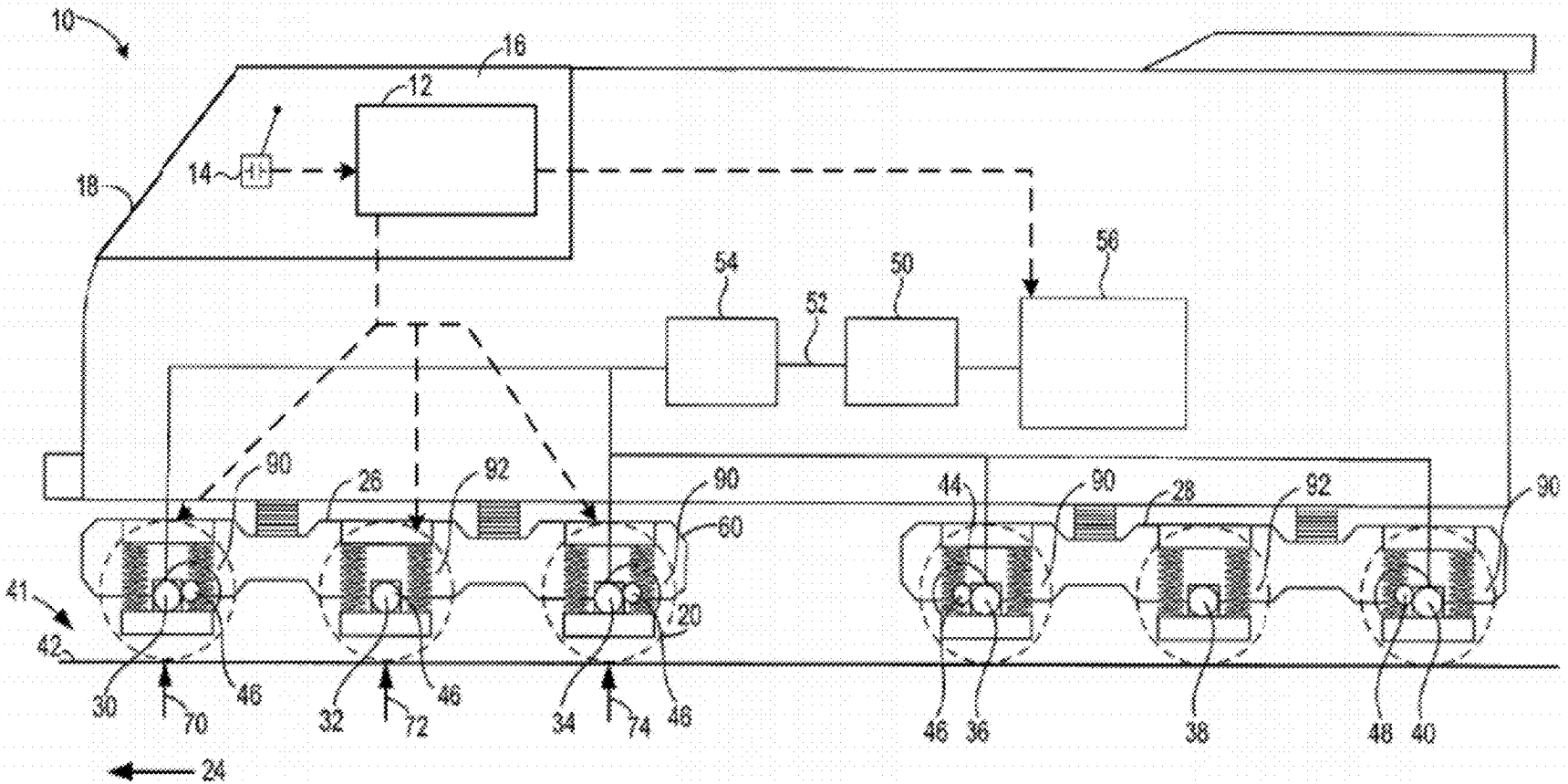
FIG. 1 shows a vehicle comprising a lift mechanism enabling dynamic vehicle weight management (DWM)

FIG. 1 illustrates a system 10 including a locomotive 18. However, in alternate examples, the embodiment of system 10 may be utilized with other vehicles, including wheeled vehicles, other rail vehicles, and track vehicles. With reference to FIG. 1, the system 10 is provided for selectively and/or dynamically affecting a normal force 70, 72, 74 applied through one or more of a plurality of locomotive axles 30, 32, 34, 36, 38, 40. The locomotive 18 illustrated in FIG. 1 is configured to travel along a track 41, and includes a plurality of locomotive wheels 20 which are each received by a respective axle 30, 32, 34, 36, 38, 40. Track 41 includes a pair of rails 42. The plurality of wheels 20 received by each axle 30, 32, 34, 36, 38, 40 move along a respective rail 42 of track 41 in a travel direction 24.

As illustrated in the example embodiment of FIG. 1, the locomotive 18 includes a pair of rotatable trucks 26, 28 which are configured to receive a respective plurality of axles 30, 32, 34, and 36, 38, 40. Trucks 26, 28 may include truck frame element 60 configured to provide compliant engagement with carriers (not shown), via a suspension (not shown). The pair of trucks 26, 28 are configured to be rotated, where one or both of the trucks 26, 28 may be rotated 180 degrees from a forward direction, to a rear direction.

Each truck 26, 28 may include a pair of spaced apart powered axles 30, 34, 36, 40 and a non-powered axle 32, 38 positioned between the pair of spaced apart powered axles. The powered axles 30, 34, 36, 40 are each respectively coupled to a traction motor 44 and a gear 46. Although FIG. 1 illustrates a pair of spaced apart powered axles and a non-powered axle positioned there-between within each truck, the trucks 26, 28 may include any number of powered axles and at least one non-powered axle, within any positional arrangement.

Each of the powered axles 30, 34, 36, and 40 include a suspension 90, and each of the non-powered axles 32 and 38 include a suspension 92. The suspensions may include various elastic and/or damping members, such as compression springs, leaf springs, coil springs, etc. In the depicted example, the non-powered axles 32, 38 may include a DWM actuator (not shown) configured to dynamically adjust a compression of the non-powered axle suspensions by exerting an internal compression force (as described with regard to FIGS. 2-3). The DWM actuator may be, for example, a pneumatic actuator, a hydraulic actuator, an electromechanical actuator, and/or combinations thereof. A vehicle controller 12 may be configured to activate the DWM actuators in response to a lift command, thereby activating the suspensions of the lift mechanism and performing dynamic weight management (DWM). By adjusting the compression of the non-powered axle suspensions, weight may be dynamically shifted from the non-powered axle 32 to the powered axles 30, 34 of truck 26. In the same way, dynamic weight shifting can also be carried out in truck 28. As such, it is possible to cause an upward force on the non-powered axles 32, 38 and increase the tractive effort of the locomotive 18 via a corresponding downward force on the powered axles 30, 34, 36, 40. For example, the weight imparted by the powered axles 30, 34 and 36, 40 on the track may be increased, while the weight imparted by the non-powered axles 32, 38 on the track is correspondingly decreased.

Returning to FIG. 1, as depicted, in one example, the locomotive is a diesel-electric vehicle operating a diesel engine 56. However, in alternate embodiments of locomotive 18, alternate engine configurations may be employed, such as a gasoline engine or a biodiesel or natural gas engine, for example. Alternatively, the locomotive may be fully electric. A traction motor 44, mounted on a truck 26, 28, may receive electrical power from alternator 50 via DC bus 52 to provide tractive power to propel the locomotive 18. As described herein, traction motor 44 may be an AC motor. Accordingly, an inverter 54 paired with the traction motor may convert the DC input to an appropriate AC input, such as a three-phase AC input, for subsequent use by the traction motor. In alternate embodiments, traction motor 44 may be a DC motor directly employing the output of the alternator after rectification and transmission along the DC bus. One example locomotive configuration includes one inverter/traction motor pair per wheel axle. As depicted herein, 4 inverter-traction motor pairs are shown for each of the powered axles 30, 34 and 36, 40.

A vehicle operator may control the operation of the locomotive by adjusting parameters input into a locomotive controller 12. For example, the vehicle operator may control the power output of the locomotive (thereby also controlling locomotive speed) by adjusting a throttle setting. The locomotive may be configured with a stepped or "notched" throttle (not shown) with multiple throttle positions or "notches". In one example, the throttle may have nine distinct positions, including an idle notch corresponding to an idle engine operation and eight power notches corresponding to powered engine operation. Additionally, an emergency air brake application corresponding to an emergency stop position may also be included. When in the idle notch position, engine 56 may receive a minimal amount of fuel enabling it to idle at low at RPM. Additionally, the traction motors may not be energized. For example, the locomotive may be in a "neutral" state. To commence operation of the locomotive, the operator may select a direction of travel (herein, also referred to as a direction call) by adjusting the position of a reverser 14. As such, the reverser may be placed in a forward, reverse, or neutral position. Upon placing the reverser in either a forward or reverse direction, the operator may release a brake and move the throttle to the first power notch to energize the traction motors. As the throttle is moved to higher power notches, the fuel rate to the engine is increased, resulting in a corresponding increase in the power output and locomotive speed. In one example, as depicted, controller 12, reverser 14, and a vehicle operator may be positioned in cab 16 during locomotive operation.

Traction motor 44 may act as a generator providing dynamic braking to brake locomotive 18. In particular, during dynamic braking, the traction motor may provide torque in a direction that is opposite from the rolling direction thereby generating electricity that is dissipated as heat by a grid of resistors (not shown) connected to the electrical bus. In one example, the grid includes stacks of resistive elements connected in series directly to the electrical bus. Air brakes (not shown) making use of compressed air may be used by locomotive 18 as part of a vehicle braking system.

As noted above, to increase the traction of driven axles of the truck (by effecting a weight shift dynamically from at least one axle of the truck to at least another axle of the truck), one embodiment uses pneumatically actuated relative displacement between the un-powered axle (e.g., 32 and/or 38) and the truck frame element 60. The relative displacement of the un-powered axle causes a change (e.g., compression) of the axle suspension 92, thus causing a shift of weight to the powered axles (and additional compression of the suspension 90) to compensate for the reduced normal force 72 at the un-powered axle. This action generates an increased normal force 70, 74 on the powered axles 30, 34, for example.

Figure 2:
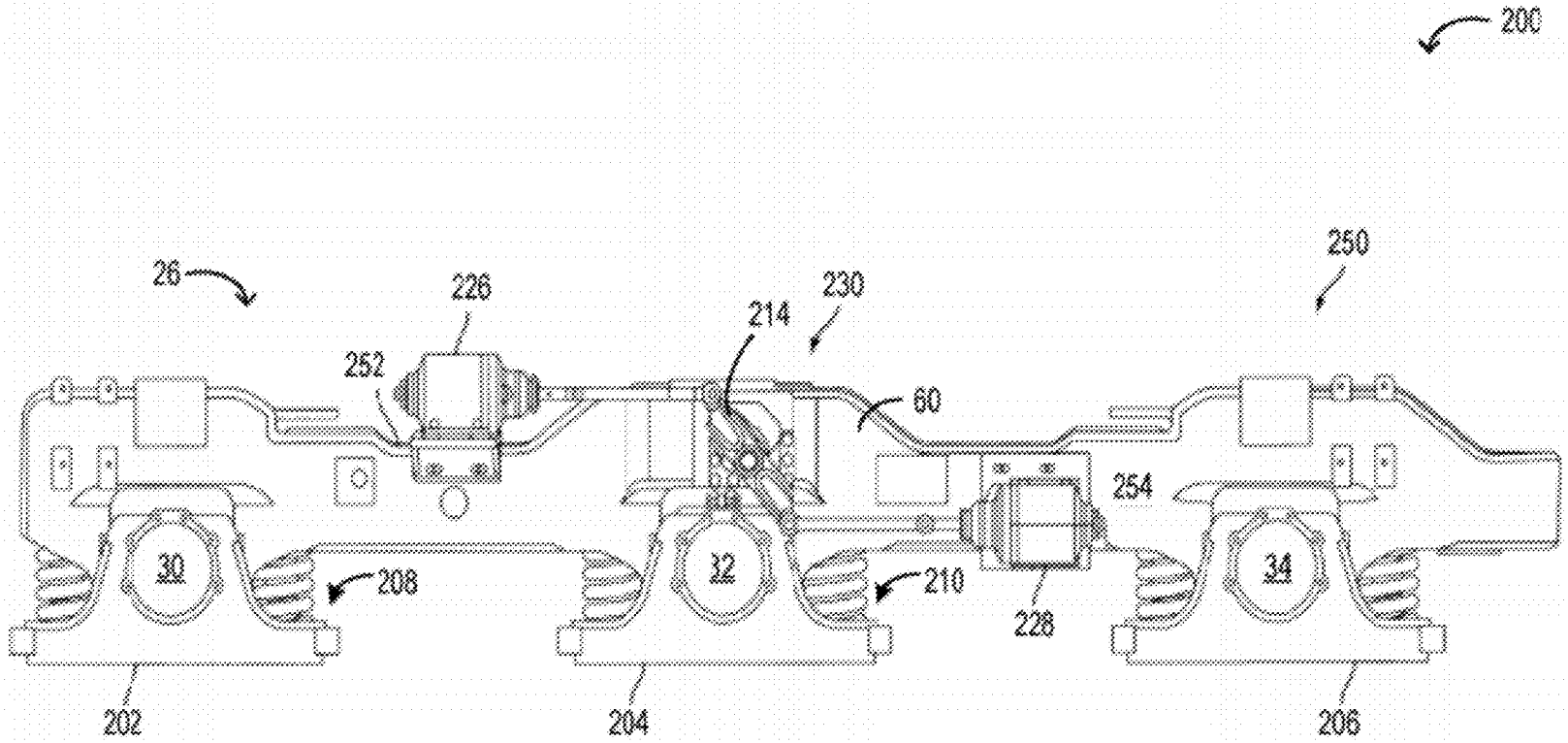
FIG. 2 illustrates a sectional view of an example truck including the lift mechanism of FIG. 1.

Referring now to FIG. 2, an example truck configuration 200 is shown including a lift mechanism (herein also referred to as a DWM mechanism) for dynamically redistributing weight between powered and un-powered axles. While the depicted example represents an example truck configuration in the front truck 26 of FIG. 1, a similar configuration may also be included in the rear truck 28. As depicted, truck 26 may include a truck frame element 60 configured for compliant engagement with carriers 202, 204, 206, via the lift mechanism. In the embodiment of FIG. 2, springs systems 208, 210, 212 represent the vehicle lift mechanism. Each carrier 202, 204, 206 may be configured to hold respective axles 30, 32, 34. Specifically, the carriers may be configured as cylindrical bushings, or the like, configured to carry the axle. Each spring system 208, 210, 212 provides a structure configured to support respective portions of the truck frame element 60, and portions of the overlying weight of the locomotive 18, and thereby bias the truck frame element 60 upward, and away from the carriers 202, 204, 206.

In some examples, portions of the weight supported by each carrier 202, 204, 206, and consequently the upward normal forces 70, 72, 74, on each of the wheels 20 may be selectively, and in some examples, dynamically, redistributed among the carriers 202, 204, 206. In some examples, the weight may be redistributed via a weight transference configured to decrease the weight on the non-powered axle 32, thereby increasing the weight on the powered axle 30, 34 and consequently the tractive effort of the locomotive 18 via a corresponding increase in the normal forces 70, 74 on the powered wheels. Truck 28 may also be similarly constructed such that the weight on the non-powered axle 38 may be decreased, increasing the weight on the powered axles 36, 40 and consequently the tractive effort of locomotive 18.

Various actuating arrangements may be employed to reduce the weight on the non-powered axle 32. For example, a pair of actuators 226, 228 may be coupled with the truck frame element 60. A first actuator 226 may be coupled to, or near, a top surface 252 of the truck frame element 60, and a second actuator 228 may be coupled to, or near, a lower surface 254 of the truck frame element 60. The actuators may be configured to share the actuating load for actuating a linkage arrangement 230. Specifically, the actuators may each generate forces in opposite directions, yet offset from one another, to generate a coupling torque that rotates a cam or lever arm to generate lifting force on carrier 204 to displace it relative to, and toward, truck frame element 60. Mechanical advantage may be used by the linkage arrangement to amplify the force from the actuators, and in some examples the mechanical advantage may vary depending on the position of the linkage arrangement. In one example, the actuators 226, 228 may be pneumatic actuators (as elaborated in FIG. 3). In alternate examples, additionally or optionally, hydraulic, magnetic, and/or various direct or indirect actuators may be used, including, but not limited to using one or more servo motors, and the like. Various configurations and numbers of actuators may be employed. In alternate embodiments, the actuators could be coupled to both powered and non-powered axles.

The actuatable linkage arrangement 230 includes a compliant linkage coupled with the carrier 204 to translate rotation of a lever arm 214 by the pneumatic actuator-generated couple into vertical motion of the carrier 204 relative to the truck frame element 60. Lever arm 214 may be coupled with a crank (not shown) and may be configured to effect the pivoting of the crank. The two actuators 226, 228 may be configured to exert forces from respectively opposite directions to exert a couple on the lever arm 214. In one example, the compliant linkage may include a chain. In alternate examples, the linkage may include a cable, a strap, a rope, slotted rigid members, or the like. The chain may be able to operate in tension (hereafter referred to as a truck chain tension) to support a load at least an order of magnitude, and often two or more orders of magnitude, greater than that in compression. By enabling the compliant linkage to pull the carrier against the bias in a first direction, it is possible to selectively control increased compression of the carrier toward the truck frame element to effect a dynamic re-distribution of the load to other axles of the truck assembly.

Spring system 210 may include one or more springs 250 configured to couple the axle to the truck frame element 60. While FIG. 2 shows two springs biasing each carrier away from the truck frame element 60, more or less springs may be used. A top end of each spring may be attached to the truck frame element 60, and a bottom end of each spring to a carrier 204. In one example, as illustrated in FIG. 2, the spring system 208 for powered axle 30 may be substantially similar to the spring system of each powered axle 34, 36, and 40, such as when the locomotive can operate in both forward and reverse directions. However, in an alternative example, a front truck may require a greater lift force to compress the carrier 204 than on a rear truck due to the natural weight transfer within the truck or the locomotive. As such, the spring system 208 may be used only for axles 30 and 34, but not on axles 36 and 40.

In one example embodiment, spring system 208 may be configured to provide a non-linear spring rate in response to a deflection between powered axles 30 and 34 and truck frame element 60. In alternate embodiments, spring system 208 may be linear and may provide a spring rate substantially similar to that of spring system 210.

Figure 3:
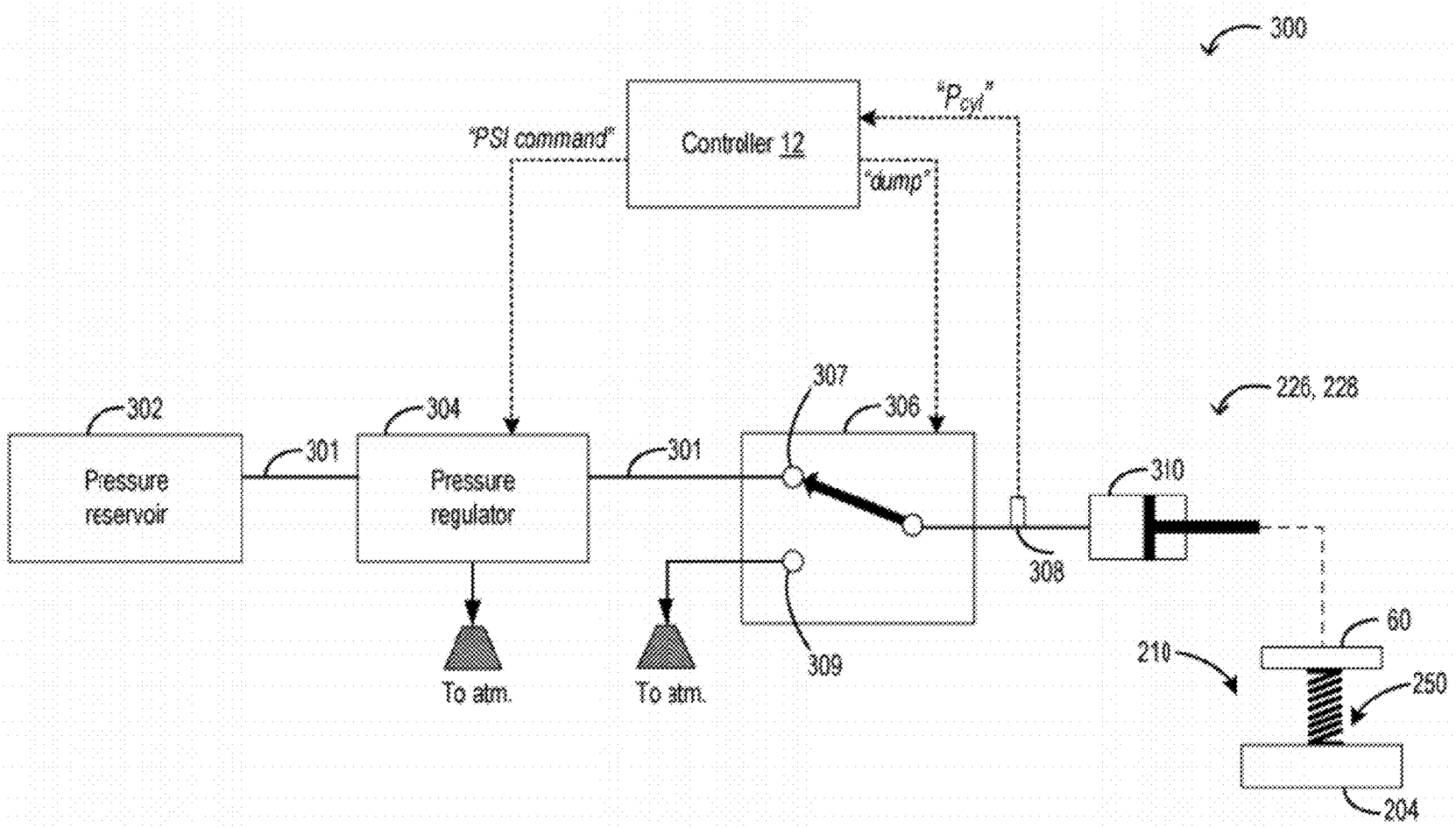
FIG. 3 illustrates an example pneumatic actuation of the lift mechanism of FIG. 2.

Now turning to FIG. 3, an example embodiment 300 for pneumatic actuation of the suspension system of FIG. 2 is illustrated. Based on a pressure command ("PSI command") issued from controller 12, a pressure regulator valve 304 may be configured to provide air pressure along pneumatic line 301 to side cylinder 310 of each pneumatic actuator 226, 228. For example, a controller may compute the pressure command based on the determined lift command. In one example, pressure regulator valve 304 may be a variable orifice pressure valve. Pressurized air may be supplied from pressure reservoir 302 to the pressure regulator valve 304. In one example, when a reduction in lift, or a DWM de-lift, is commanded by controller 12 (for example, in response to the absence of lift conditions), the pressure in pneumatic line 301 may be gradually ramped down by pressure regulator valve 304 by slowly dissipating pressurized air to the atmosphere (atm). When reducing the lift, the controller may further specify a ramp-down rate. The ramp-down rate may be based on, for example, a level of lifting, a vehicle speed, and/or a vehicle tractive effort. In another example, when the pressure commanded is lower than the pressure supplied from the pressure reservoir, the difference in pressure may be dissipated to the atmosphere (atm) by the pressure regulator. In another example, there may be two valves which are independently controlled, one to increase the pressure and another to decrease the pressure, and the actual pressure regulation itself may be achieved by the controller using the pressure feedback. In one example, when the maximum pressure applied is limited, the line pressure may be estimated from the tractive effort obtained as well.

The pressure regulator may be coupled to side cylinder 310 along pneumatic line 301 via a dump valve 306. In one example, dump valve 306 may be an electromagnetic dump valve alternating between an open position 309 and a closed position 307. Specifically, dump valve 306 may remain in a default closed position 307 until enabled or activated by the passage of an electric current, at which time dump valve may shift to the open position 309. In response to a "dump" command, controller 12 may enable the dump valve and the pressure in pneumatic line 301 may be "dumped" to the atmosphere, rapidly and almost instantaneously bringing the air pressure in the line down, for example down to a range of 0-5 psi. In this way, a quick deactivation of the lift mechanism may be provided, for example, in response to a sudden application of friction brakes during an emergency air brake event. Thus, a more rapid lift reduction may be achieved to thereby reduce sliding of the axle. A controlled deactivation of the DWM mechanism may be used during a de-lift operation (e.g., during an operation wherein the locomotive is changed from operating with lift to operating with no lift, or less lift). It will be appreciated that while the figure depicts a single side cylinder communicating with a single spring of the spring system, a similar command may be given in parallel to another side cylinder communicating with the second spring of the spring system.

During a DWM lift operation, dump valve 306 may remain closed and pressure regulator valve 304 may generate a pressure in the pneumatic line 301 based on the commanded pressure. A pressure sensor 308 may monitor the pressure ($P_{cyl}$) in the line. The commanded pressure may be transferred to side cylinder 310. The movement of side cylinder 310 may then be relayed to and transformed into a corresponding lift in spring system 210. In one example, when an increase in lift is commanded (herein also referred to as a DWM lift), the movement of side cylinder 310 may enable springs 250 of spring system 210 to decrease their compression rate, thereby bringing carrier 204 closer to truck frame element 60. In another example, when a decrease in lift is commanded (or when a DWM de-lift is commanded), the movement of side cylinder 310 may enable springs 250 of spring system 210 to increase their compression rate, thereby pushing carrier 204 further from truck frame element 60. The controller, when performing DWM control, is responsible for the air pressure on the DWM pneumatic cylinders, which in turn shift weight from non-powered to powered axles on the locomotive. In one example, a push mechanism is used to perform the DWM lift under some conditions and an alternate mechanism (such as a pull mechanism) is used to perform a DWM de-lift under different conditions.

In an alternate embodiment, dump valve 306 may be an electromagnetic valve. Herein, the electromagnetic dump valve may be charged to hold a determined cylinder pressure with or without pressure feedback.

The controller may be configured to adjust the lift mechanism to reduce lift by opening a (first) dump valve during a first operating condition, and reduce lift by opening a (second) regulator valve during a second operating condition. As such, the dump valve may allow for a faster reduction in lift. For example, during a vehicle friction braking condition, the controller may reduce lift (for example, completely reduce lift to a zero lift state) by opening the dump valve. In comparison, during a condition where the vehicle is moving into a low gradient zone (from a high gradient zone), the controller may more slowly reduce lift (for example, slightly reduce lift to a decreased lift state) by opening the regulator valve 304.

Referring now to the control operation as illustrated in FIGS. 4-9, a controller may be configured to adjust the DWM mechanism based broadly on locomotive performance characteristics. The controller may adjust the authority of the DWM operation based on predefined maximum and minimum weight limits on the powered and unpowered axles. In one example embodiment, the weight on the powered axle may be 95,000 lbs and the weight on the un-powered axle may be 15,000 lbs, and this 95/15 configuration may represent a condition of most aggressive DWM authority (e.g., a condition of most weight on the powered axle, least weight on the un-powered axle, and highest DWM component and truck stress). The DWM operation may also be adjusted based on the vehicle speed. Thus, as a locomotive speed drops, the DWM authority may increase. The DWM controller may be configured to use an operating map including defined regions wherein weight shift may be increased if adhesion-limited axles are present. For example, the controller may permit a weight shift up to a weight of 90,000 lbs on the powered axles, as needed, unless a stall risk is detected. In case of a stall, a weight shift of up to 95,000 lbs on to the powered axle may be tolerated. Similarly, DWM weight limits may be enforced that would initiate a DWM de-lift action. Herein, the de-lift region limits may be higher than the lift region limits to provide a hysteresis to avoid cycling between lift and de-lift operations.

Figure 4:
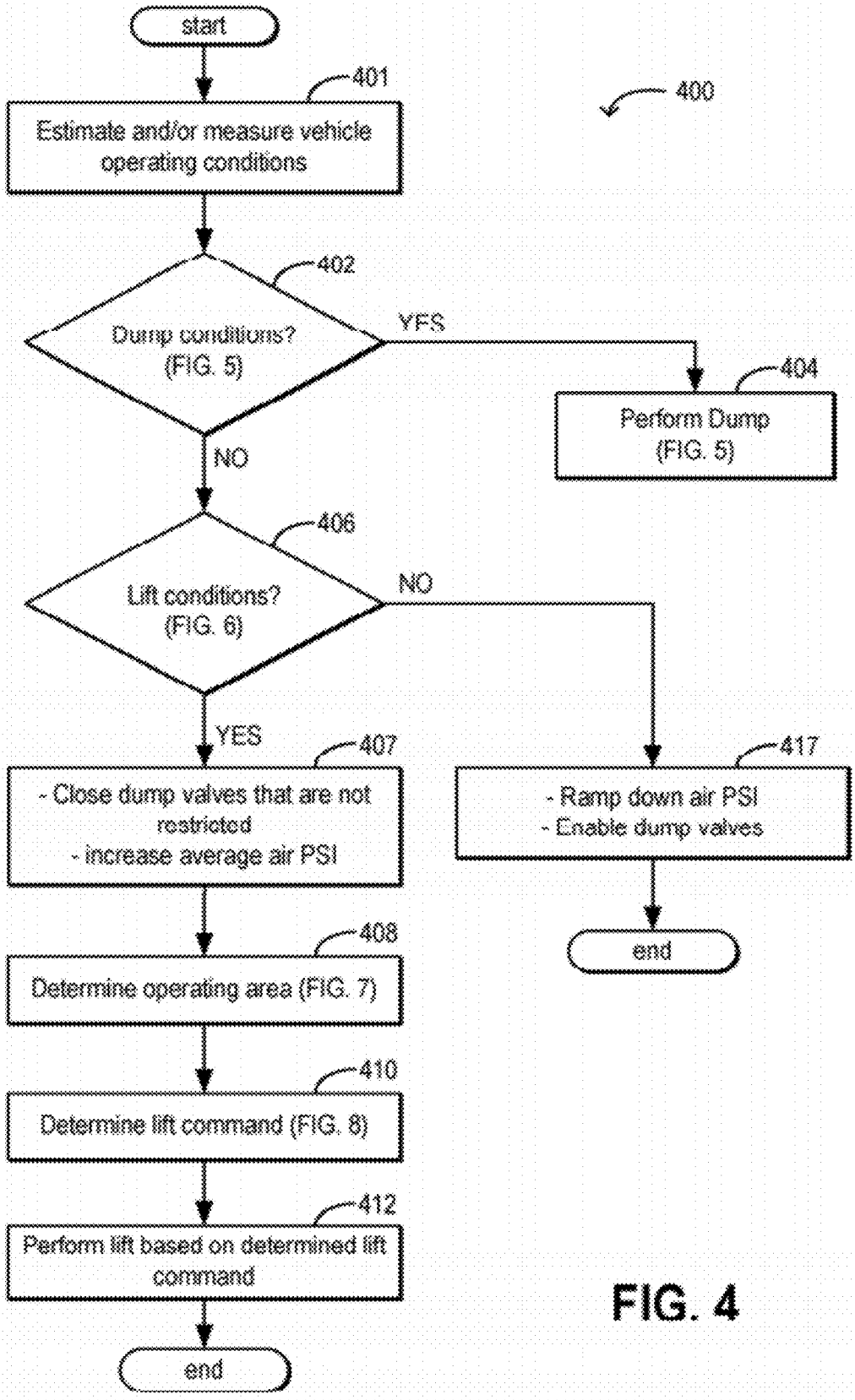
FIG. 4 shows a high level flow chart of a method for selecting an amount of lift in a vehicle lift mechanism according to the present disclosure.

Now turning to FIG. 4, a routine 400 is described for selecting an amount of lift in the vehicle suspension system of FIG. 1 in response to vehicle operating conditions. The routine may be performed, for example, by the vehicle controller 12, at the start of and during vehicle operation, to dynamically redistribute the locomotive load between the powered and non-powered axles.

At 401, vehicle operating conditions may be estimated and/or measured. These may include estimating environmental conditions external to the vehicle, such as an ambient temperature, pressure, humidity, weather conditions, etc. A rail track condition (or quality of the track on which the vehicle travels) and a geographical input of the location along the rail track may be determined, for example based on information from a global positioning system (GPS) and/or from a track database. Operator inputs such as a requested notch, a reverser position (e.g., a direction call), and a desired torque (for example, from a throttle position) may be determined. Further still, a fuel amount may be determined based on a fuel tank sensor. The number of locomotives and cabs in the locomotive consist may be determined. Further still, it may be determined whether the locomotive is in a short hood or long hood direction (e.g., whether the short hood or the long hood is forward in the direction of travel), and a direction of travel. Similarly, various other vehicle operating conditions may also be determined.

At 402, it may be determined whether any dump conditions are present. As such, the dump conditions may correspond to vehicle operating conditions and/or locomotive component conditions under which the performance (or maintenance) of a lift operation and the redistribution of weight may adversely affect the vehicle performance and/or the operating condition of locomotive components (for example, by increasing axle sliding and slip). These conditions wherein a lift may not be desired may include, for example, emergency air brake application conditions. Thus, under such dump conditions, even if a lift could be performed, the lift operation may be overridden and a dump operation may be performed instead at 404. As such, this may represent a failure mode (or emergency mode) of the control system wherein locomotive degradation due to a lift command may be anticipated and accordingly some or all of the lift may be "dumped". Further details of an example dump operation are provided herein with reference to FIG. 5.

If no dump conditions are identified at 402, then at 406, lift conditions may be confirmed. For example, it may be confirmed whether the vehicle operating conditions permit a lift operation. As further elaborated with reference to FIG. 6, in one embodiment, based on locomotive operating conditions including locomotive speed, locomotive notch, truck restrictions, motoring state of the vehicle, time elapsed since a previous lift and/or dump operation, the possibility of a stall (e.g., a vehicle stall risk), and/or the gradient of the track, a controller may determine a running state of the locomotive, for example, whether the locomotive is in a condition of starting with no lift, starting with lift, running with no lift, or running with lift. In one example, the controller may additionally determine whether a transition between the states is possible.

The routine may also be configured to limit or restrict an amount of lift, and thus an amount of weight transfer between axles, based on operating conditions such as the location of the locomotive and/or infrastructure conditions, such as rail conditions. For example, if a specific section of rail can only support limited weight (for example, due to degraded rail quality in a particular section), when that section is reached, the lift operation may be limited. In one example, this may be achieved with the help of a geo-sensing system. The geo-sensing system may include a track database including information regarding the quality, grade, current condition, etc. of tracks along the route the locomotive is expected to travel. The system may also include information regarding the presence of bridges, and the condition of the bridges, the presence of ballasts, the condition of ballasts, etc. Predetermined geographic zones may be stored on an on-board control system (OBS) of the locomotive and may include a location determination system, such as a global positioning system (GPS). In one example, the predetermined geographic zones may be set up as "non-permissible zones", such that when the locomotive is approaching and/or transitioning through those zones, a weight shift operation is prevented. Alternatively, the predetermined geographic zones may be set up as "permissible zones", such that when the locomotive is approaching and/or transitioning through those zones, a weight shift operation is enabled. The geographic zone restrictions may be implemented automatically or using manual inputs, such as by the operator enabling a switch or providing authorization from off-board the system using communications. In one example, such geographic zone-based weight transfer restrictions may be enforced alongside dump conditions and/or lift conditions, or may be enforced as limits on the lift command (for example, by assigning a zone-based maximum weight, maximum weight transfer, zone-based truck restriction, zone-based axle restriction, zone-based locomotive position restriction, etc.). In this way, by adjusting the weight transfer operation in an infrastructure-sensitive manner, detrimental track forces may be reduced and ride quality may be improved.

If no lift conditions are confirmed at 406, e.g., if the locomotive is in a state of starting with no lift or running with no lift, the routine may move to 417 and ramp down the air pressure in the lift mechanism actuators (herein also referred to as lifters). For example, the air pressure in the lifters may be gradually reduced towards 0 psi (for example, by bringing it down to 5 psi) to avoid a lift. In one example, a controller may adjust the operation of an electro-pneumatic pressure regulator valve to gradually ramp down the pressure in the lifters. In another example the controller may command a valve to slow bleed the air down. If the air pressure has not reduced after a threshold time since the ramp down was initiated (for example, after 60 secs), the controller may enable the dump valves and rapidly reduce the air pressure towards 0 psi. In comparison, if lift conditions are confirmed at 406, e.g., if the locomotive is in a state of starting with lift or running with lift, the routine may move to 407 and close any dump valves that are not restricted. Additionally, the average air pressure in the lift mechanism may be increased to increase the authority of DWM lift operations.

Next, at 408, the routine may determine a lift condition operating area based upon a map, such as the example map of FIG. 7. In one example, the map may represent different lift condition operating areas as a function of vehicle speed and net vehicle tractive effort. Based on the position of the locomotive in the lift condition map, the lift options available under the given operating conditions may be determined. As further elaborated with reference to FIG. 7, it may be determined, for example, whether at the given locomotive speed and at the prevalent tractive effort, if the locomotive may be started with a lift or run with lift, or whether the amount of lift may be increased, decreased, or held.

Based at least on the position of the locomotive in the lift condition map, and further based on parameters such as the risk of a vehicle stall, the presence of wheel slip, the gradient and state of the track, the vehicle operating conditions, etc., a lift command may be determined at 410. As further elaborated with reference to FIG. 8, the routine may employ a lift selection algorithm receiving input from the various locomotive parameters to determine the lift command, including determining an amount and nature of lift. For example, it may be determined whether an amount of lift is to be increased, decreased, or held, and further to determine the rate at which the lift is to be increased or decreased. For example, when a decrease lift command is issued, reducing the lift may include ramping down the determined amount of lift at a ramp-down rate, the ramp-down rate based at least on a level of lifting (e.g., the amount of lift prevalent before the ramp-down was commanded), vehicle speed, a track grade, and/or a vehicle tractive effort. In another example, reducing the lift may include providing no lift.

At 412, based on the determined lift command, the lift operation may be performed. As such, this may include converting the lift command into an appropriate pressure command that is then relayed to the lift mechanism actuators. In this way, the lift mechanism may be adjusted responsive to various operating conditions to provide the determined amount of lift.

Figure 5:
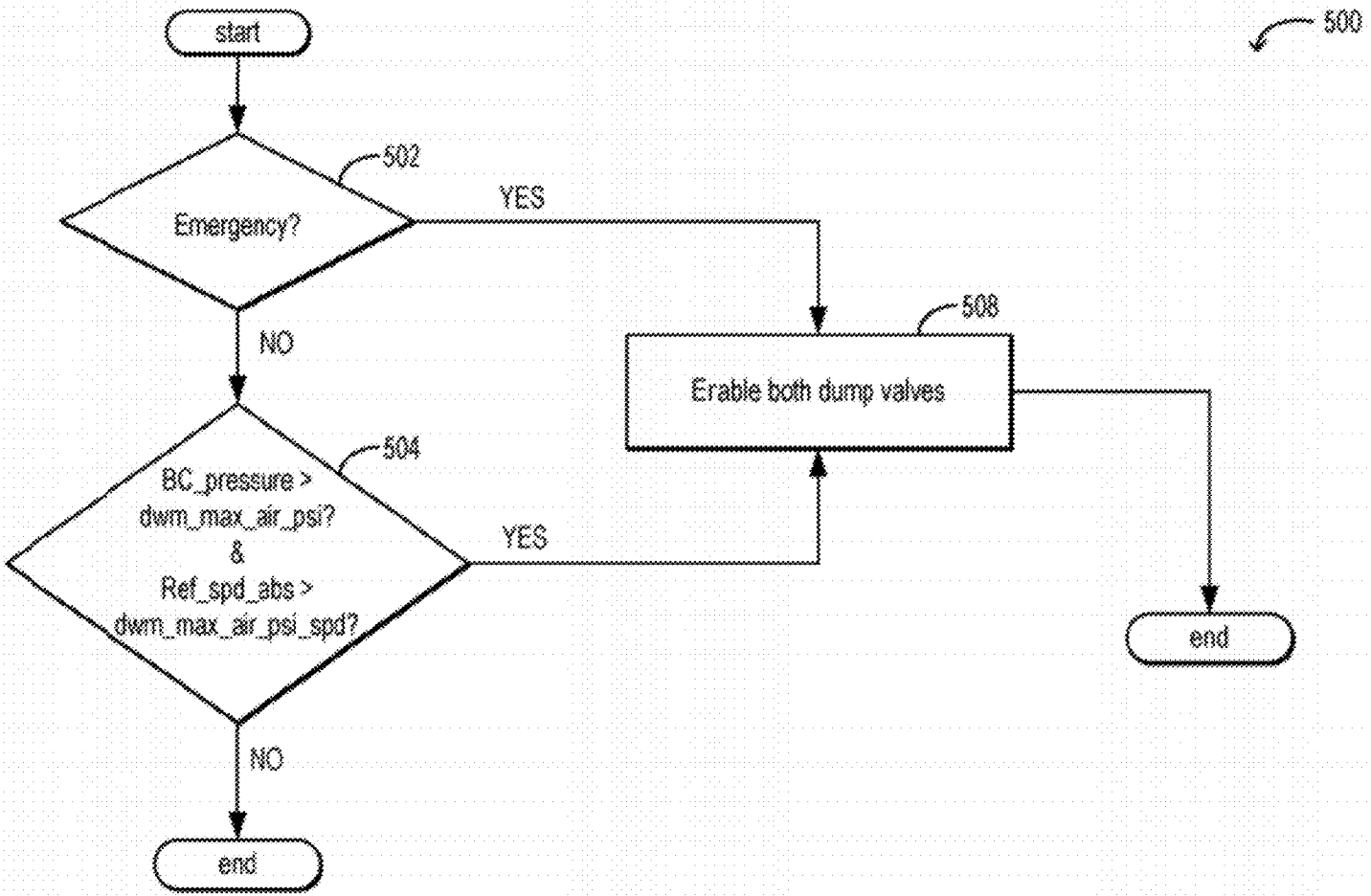
FIG. 5 shows a high level flow chart of a method for adjusting the vehicle lift mechanism in response to dump conditions.

Now turning to FIG. 5, routine 500 depicts an example dump operation that may be performed in response to the presence of dump conditions. As such, the dump conditions may represent conditions wherein a lift command, even if possible, may not be desired. Thus, the dump operation may take priority over a lift operation and thereby forestall potential issues arising from an undesirable lift operation. The dump operation may enable a lift operation to be quickly deactivated and a lift to be rapidly reduced.

At 502, it may be determined whether there are any emergency conditions. In one example, the emergency conditions may include the detection and/or prediction of undesirable amounts of unpowered axle wheel slide or negative creep. In another example, the emergency conditions may include the sudden application of emergency air brakes (or friction brakes). If emergency conditions are confirmed, at 508 the routine may enable both the dump valves of the suspension system to thereby provide substantially no lift. As previously elaborated, by enabling both the dump valves, the air pressure in the pneumatic line of the lift actuators may be rapidly reduced, thereby quickly deactivating the lift operation.

If no emergency conditions are identified at 502, at 504 it may be determined whether the vehicle is in a braking mode. For example, it may be determined whether the brake cylinder pressure (BC pressure) is greater than a threshold (dwm_max_air_psi), for example above 30 psi, and whether the vehicle speed (ref_spd_abs) is greater than a threshold (dwm_max_air_psi_spd), for example above 5 mph. In response to vehicle braking, the determined amount of lift may be reduced. For example, as illustrated herein, reducing the lift may include providing no lift by opening a dump valve of the lift mechanism. Specifically, if the braking conditions are confirmed at 504, then the routine may proceed to 508 and enable the dump valves of the lift mechanism, thereby disabling lift. In this way, an amount of lift may be rapidly disabled in response to vehicle air braking, thereby reducing unpowered axle slide risk.

In still other examples, instead of dumping the actuation pressure, a controller may sequentially open a regulator valve and a dump valve based on vehicle operating conditions. For example, during a first operating condition, the controller may open a first dump valve to reduce lift. In another example, during a second operation condition, the controller may open a second regulator valve (such as pressure regulator valve 304 of FIG. 3) to reduce the lift. In one example, following the issue of a reduce lift or DWM de-lift command, the pressure regulator may start releasing pressure to the atmosphere, and at the same time, a timer may be started. Following the elapse of a threshold time, for example 60 seconds, the pressure in the pneumatic line may be determined (for example, by a pressure sensor). If the estimated pressure has not dropped below a threshold, and/or the rate of pressure drop is not above a threshold, and/or when the time has expired the controller may enable the dump valve and "dump" the remaining pressure to the atmosphere. In this way, when no lift is desired or required, pressure to the pneumatic actuators may be rapidly reduced.

As such, the conditions depicted at 502-504 represent example dump conditions that may be queried as part of and at the beginning of the lift determination routine 400 (at 402). It will be appreciated that additional or alternate dump conditions may also be confirmed in the dump operation of FIG. 5. In this way, by performing a dump operation responsive to dump conditions or emergency conditions and conditions that may potentially impair locomotive operation, and by allowing the dump operation to take priority over a lift operation, locomotive damage from lift operations may be reduced. For example, by rapidly deactivating the DWM lift force responsive to emergency conditions, sliding of the unpowered axles may be reduced.

Now turning to FIG. 6, an example state diagram 600 is depicted to identify lift conditions, for example as may be used as part of routine 400 (at 406). State diagram 600 may be used by a controller to determine whether the operating conditions permit a lift of the locomotive to be initiated or maintained.

The state diagram determines a running state of the locomotive. In the depicted example, the locomotive may be in one of four running states including running with or without lift and starting with or without lift. Following a powering up of the locomotive, the locomotive may initially be in a state of starting with no lift (starting_no_lift 602). From here, the locomotive may either be transitioned to a state of starting with lift (starting_lift 606) or a state of running with no lift (running_no_lift 614). The locomotive may enter starting_lift 606 from starting_no_lift 602 in response to conditions 604 including, the locomotive notch being above a threshold value (dwm_trs_slift_enter_notch), for example, above notch 3, the locomotive being in a motoring condition, the locomotive speed being below a threshold speed (dwm_trs_min_spd), for example, below 3 mph, when at least one truck of the locomotive is unrestricted, and the locomotive is started on a hill. In the presence of conditions 604, a controller may start the locomotive with the lift mechanism activated and with at least some lift in place. In one example, once conditions 604 for a transition are satisfied, a timer may be started and upon the elapse of a threshold time (dwm_trs_slift_tm), for example 5 seconds, the transition may be completed. Additionally, a controller may note the direction of locomotive movement (dir_call), for example as determined by a reverser position. The locomotive may return from starting_lift 606 to starting_no_lift 602 in response to conditions 616 including, the locomotive not being motored, the locomotive notch being below a threshold notch (dwm_trs_slift_exit_notch), for example notch 3, or when both trucks of the locomotive are restricted.

Alternatively, the locomotive may enter the state running_no_lift 614 from the starting_no_lift 602 in response to conditions 618 including the locomotive speed being above a threshold speed (dwm_trs_min_spd), for example, above 3 mph. The locomotive may return from running_no_lift 614 to starting_no_lift 602 in response to conditions 620 including the locomotive speed being below a threshold speed (dwm_trs_slift_exit_spd), for example below 3 mph.

For the locomotive to transition from starting_lift 606 to running_no_lift 614, it may be required to transition through a state of running with lift (running_lift 610). The locomotive may enter running_lift 610 from starting_lift 606 in response to conditions 608 including the locomotive speed being above a threshold speed (dwm_trs_slift_exit_spd), for example, above 5 mph, the locomotive being in a motoring condition, and when at least one truck is not restricted. As such, the locomotive may not be able to return to the state of starting_lift 606 from the state of running_lift 610 without transitioning successively through the states of running_no_lift 614 and starting_no_lift 602.

The locomotive may enter running_no_lift 614 from running_lift 610 in response to conditions 612 including the locomotive speed being above a threshold speed (dwm_trs_rlift_exit_spd), for example, above 18 mph, when both trucks are restricted, the locomotive is in a non-motoring condition, or when a threshold time (dwm_trs_rlift_exit_tm) has elapsed on a timer, for example, 2 hours. Additionally, the controller may ensure that the direction of locomotive movement is not the direction called by the operator (dir_call). The locomotive may return from running_no_lift 614 to running_lift 610 in response to conditions 622 including the locomotive speed being below a threshold speed (dwm_trs_rlift_enter_spd), for example, below 17 mph, when at least one truck is not restricted, the locomotive being in a motoring condition, and the locomotive notch being above a threshold value (dwm_trs_rlift_enter_notch), for example, above notch 8.

When the locomotive is in a condition with lift, e.g., in starting_lift 606 or running_lift 610, the control system may increase the air pressure in the main air reservoir by way of the air compressor. This is done in order to provide adequate system air pressure of the weight shift mechanism actuators. A controller may command the air pressure to be maintained above a minimum threshold pressure, for example, above 135 psi. Additionally, when the locomotive is in the state of running_lift 610, and the locomotive speed is below a threshold speed (dwm_trs_rlift_stop_spd), for example, below 0.1 mph, the threshold time (dwm_trs_rlift_exit_tm) required to transition the locomotive to running_no_lift 414 may be incremented, for example, incremented beyond 2 hrs, to try to provide the desired lift. If however no lift can be provided after the elapse of the threshold time, the timer may be reset. By increasing the average system air pressure upon activation of the DWM mechanism, a higher authority may be provided to the lift operation.

Now turning to FIG. 7, an example map 700 is illustrated that may be used as part of routine 400 (at 408) to identify a lift condition operating area. A controller may identify the position of the locomotive within map 700 based on locomotive operating conditions, including a vehicle speed and a net tractive effort. Based on the position of the locomotive on the map, the controller may determine lift options available. Specifically, the controller may determine whether the locomotive may be started or run with lift, and further whether an amount of lift may be increased, decreased, or held.

As depicted, map 700 may be represented in terms of locomotive speed and a net tractive effort. Based at least on the locomotive speed and/or the net tractive effort available, the controller may position the locomotive in one of eight operating areas 701-708. Based on the operating area, a corresponding lift option may be determined, for example using a look-up table such as table 710. Using map 700 and table 710, an amount of lift (e.g., the lift command) may be adjusted based on the available tractive effort of the vehicle.

The locomotive may be positioned in a first operating area 701 when the locomotive speed is below a first threshold (for example below 10 mph), and the tractive effort is below a first threshold (for example below 105 klbs). As depicted in table 710, when located in operating area 701, the lift options available are hold (hold the amount of lift present), lift-start (start with lift), lift-run (run with lift), and lift-stall (lift provided in the event of a potential vehicle stall).

The locomotive may be positioned in a second operating area 702 when the locomotive speed is below the first threshold (for example, below 10 mph) and the tractive effort is above the first threshold but below a second threshold (for example above 105 klbs but below 130 klbs). When located in operating area 702, the lift options available are hold, lift-start, lift-run, and lift-min (operate with a minimum amount of lift). The locomotive may be positioned in a third operating area 703 when the locomotive speed is above a second threshold but below the first threshold (for example, above 3 mph but below 10 mph). Additionally, the tractive effort may be above the second threshold (for example, above 130 klbs). When located in operating area 703, the lift options available are hold, and lift-min.

The locomotive may be positioned in a fourth operating area 704 when the locomotive speed is below the second threshold (for example, below 3 mph) and the tractive effort is above the second threshold (for example above 130 klbs). When located in operating area 704, the lift options available are hold, and lift-start. The locomotive may be positioned in a fifth operating area 705 when the locomotive speed is above the first threshold but below a third threshold (for example, above 10 mph and below 13 mph). Furthermore, in this operating area, the tractive effort available is no more than 90% of the maximum tractive effort possible for the engine's given horsepower. When located in operating area 705, the lift options available are hold, lift-run, and lift-min.

The locomotive may be positioned in a sixth operating area 706 when the locomotive speed is above the third threshold but below a fourth threshold (for example, above 13 mph but below 17 mph) and the tractive effort is below 90% of the maximum tractive effort possible for the engine's given horsepower. When located in operating area 706, the lift options available are hold, lift-run, lift-min, and lift decrease (e.g., ramp down the lift amount). The locomotive may be positioned in a seventh operating area 707 when the locomotive speed is above the first threshold but below the fourth threshold (for example, above 10 mph but below 17 mph) and the tractive effort is above 90% of the maximum tractive effort possible for the engine's given horsepower. When located in operating area 707, the lift options available are hold, lift lift-min and lift-decrease. Finally, the locomotive may be positioned in an eighth operating area 708 when the locomotive speed is above the fourth threshold (for example, above 17 mph). When located in operating area 708, the lift options available are hold, and lift-decrease, where a determined amount of lift may be limited to lower amounts as the vehicle speed increases. As such, above a fifth threshold speed, such as critical speed ($speed_{crit}$), the locomotive may not be operated with lift anymore. In one example, the critical speed may be 18 mph. In alternate examples, the determined amount of lift may be limited to lower amounts as the vehicle speed increases, for example, as the vehicle speed increases beyond the threshold speed. By preempting a weight shift to the powered axles at speeds above a threshold speed, the compressed primary suspension mode may be avoided at higher speeds, thereby reducing the detrimental impact thereof on ride quality and track forces.

As mentioned, based on the locomotive operating conditions, and further based on the position of the locomotive in map 700, potential lift commands may be determined. In one example, when the locomotive is in operating area 701, and the locomotive notch is above a threshold, for example, notch 5, the pressure commanded to the lift mechanism actuators may be increased. In comparison, when the notch is below 5, the pressure commanded to the lifters may be held. In another example, when the locomotive is in operating area 702, and the locomotive is in a stalled state, or is starting with a lift, or when the truck chain tension is below a threshold, for example, the truck chain tension has not persisted at 4000 lbs for more than 1 second, the pressure commanded to the lift mechanism actuators may be increased. Else, the pressure commanded to the lifters may be held. In yet another example, when the locomotive is in operating area 703, and the truck chain tension has not persisted at 4000 lbs for more than 1 second, the pressure commanded to the lift mechanism actuators may be increased. Else, the pressure commanded to the lifters may be held. In still another example, when the locomotive is in operating area 704, and the locomotive is starting with a lift, the pressure commanded to the lift mechanism actuators may be increased. Else, the pressure commanded to the lifters may be held.

In another example, when the locomotive is in operating area 705, and the truck chain tension has not persisted at 4000 lbs for more than 1 second, the pressure commanded to the lift mechanism actuators may be increased. Else, the pressure commanded to the lifters may be held. In yet another example, when the locomotive is in operating area 706, and the truck chain tension is more than a threshold, for example, has persisted at more than 36000 lbs for more than 1 second, the pressure commanded to the lift mechanism actuators may be decreased.

In another example, when the locomotive is in operating area 707, and the truck chain tension has persisted beyond 6000 lbs for more than 1 second. Else, the pressure command may be held. In still another example, when the locomotive is in operating area 708, and the locomotive speed is above the critical speed, the same thresholds as described for area 707 apply for pressure reductions in area 708 except there is no requirement for a minimum chain tension.

Now turning to FIG. 8, an example control system 800 is depicted that may be used as part of routine 400 (at 410) to determine a lift command. In one example, a lift selection algorithm 802 may determine an amount of lift to be commanded, and then adjust the determined amount of lift based on the various interactions and parameters to get a final lift command 820. In one example, the determined amount of lift may be based on locomotive parameters including, for example, any combination of a wheel diameter, a fuel level, vehicle axle tractive efforts, wheel torque, a torque direction, a vehicle direction of travel, sanding interactions, track grade, friction braking forces, a knowledge of static axle weights, etc.

Lift selection algorithm 802 may calculate lift command 820 based at least on the operating area 807 of the locomotive, e.g., the position of the locomotive in the lift condition map of FIG. 7. The algorithm may further receive input regarding potential vehicle stall risk 804. As further elaborated with reference to FIG. 9, the stall risk 804 may be determined based on a stall state. In one example, a vehicle stall risk may be identified based on a vehicle speed decrease under selected wheel slipping conditions. Based on the nature of the stall state 804, the lift command may be adjusted in the lift selection algorithm 802. For example, in response to a vehicle stall risk, the determined amount of lift may be increased to thereby provide increased traction. For example, the determined amount of lift may be increased as the wheel slip related tractive effort reduction increases. The dynamic weight management may be more aggressive if there is a risk of train stall, including providing larger powered axle weights, lighter non-powered axle weights, and higher lift mechanism component stresses. In one example, increasing the determined amount of lift in response to a vehicle stall risk may include, performing a manual or automatic sand application to increase the tractive effort, and if a desired tractive effort is not produced, increasing the determined amount of lift.

Lift command 820 may also be adjusted responsive to a braking condition, for example, as determined by a brake cylinder pressure 806. For example, in response to vehicle braking (e.g., when brake cylinder pressure is greater than a threshold), the determined amount of lift may be reduced. In one example, in response to vehicle braking, a de-lift operation may be commanded and the lift may be reduced to a condition of substantially no lift, for example by opening a dump valve of the lift mechanism.

The lift selection algorithm 802 may also receive input regarding vehicle slip 808, (for example, the presence or absence of slip, an amount of vehicle slip, the number and identity of slipping axles, etc.). The algorithm may additionally consider sanding interactions 810. The sanding interactions 810 may enable sanding control to be coordinated with the lift control to reduce the amount of dynamic weight redistribution. As such, the sanding operation may be applied to improve the tractive effort of the vehicle, for example, in response to a reduction in tractive effort due to wheel slip. For example, in response to a vehicle stall risk, for example due to wheel slip, the controller may first attempt to sand the rails. Then, in response to the effect of the sanding on the slip, an amount of lift may be adjusted. For example, if the sanding helps to improve the tractive effort, the lift mechanism may not necessitate activation. In another example, if the sanding does not help to reduce the slip and increase tractive effort, the lift operation may be increased. In one example, in the presence of vehicle slip and in response to a vehicle sanding operation, if vehicle slip has not substantially decreased, then the amount of lift commanded may be increased. In comparison, in the presence of vehicle slip and in response to a vehicle sanding operation, if vehicle slip has substantially decreased, then the amount of lift commanded may be decreased. Sanding interactions may also compensate for a weight of sand within a locomotive sand applicator. In still other examples, the lift mechanism may be commanded to perform a lift before the automatic sand application on order to reduce sand use. For example, when the amount of sand is above a threshold, a controller may attempt to improve the tractive effort with the sand application first, and then apply a lift command if the sand application does not produce the desired tractive effort. In contrast, when the amount of sand is below a threshold, for example, the controller may perform a lift command before the sand application.

Lift command 820 may also be adjusted responsive to a vehicle penalty 809. A vehicle control system may include computer readable storage medium with instructions for determining a vehicle penalty. The vehicle penalty may include a combined truck penalty for the multiple trucks, as well as penalty for the various other locomotive components. As such, the penalty may reflect the amount of stress on the various locomotive components and the underlying rail. The vehicle penalty may be determined based on at least lift mechanism component stress, wheel slip, vehicle stall risks, fuel level, and lift mechanism actuator forces. Based on the determined vehicle penalty, the control system may limit the determined amount of lift. The limiting may include, reducing the determined amount of lift as the determined vehicle penalty increases. In one example, in response to the vehicle penalty being below a threshold, the lift command may be increased. In another example, if the vehicle penalty is above the threshold, the lift command may be reduced and/or a de-lift operation may be commanded to reduce component over-stress and potential vehicle slide.

The lift command may also be adjusted based on infrastructure conditions 805. The infrastructure conditions may include, for example, one of a reduced track quality, a reduced bridge stability, a reduced ballast quality, and a reduced tie quality. In response to an infrastructure condition, the determined amount of lift may be reduced and/or limited. For example, the amount of lift may be limited to lower amounts when the quality of the rail track is poor. In one example, as previously elaborated, the infrastructure conditions 805 may be determined from a track database and/or a global positioning system (GPS). In another example, the infrastructure condition may be manually input. In another example, the amount of lift may depend on the strength or type of infrastructure over which the locomotive is operating (such as a bridge). A GPS along with on-board track database or other wireless communication, may determine infrastructure conditions 805 at any given time.

The lift command may, similarly, be adjusted based on the gradient of the track on which the locomotive is running, or will be running. In one example, the hill state or grade may be recalculated at the start of a vehicle operation. In another example, the grade or hill state may be determined from a previous vehicle shut-down (for example, by storing the details of the grade or hills state in a controller memory during the previous shut-down). In another example, the grade may be determined and/or adjusted based on input from a track database and/or a global positioning system included in the locomotive cab (for example, as part of an on-board control system). The lift may be adjusted based on the presence or absence of a hill condition (e.g., based on a gradient and/or a degree of the gradient), and further based on whether the gradient is present at the time the vehicle is starting to operate or later. For example, the lift may be adjusted when the vehicle is starting on a hill. This is because the weight distribution between the axles may be markedly distinct when starting the vehicle on a hill in comparison to starting the vehicle on a flatter ground. In one example, the amount of lift may be based on the grade of the vehicle during the initial movement of the vehicle from rest. For example, the determined amount of lift may be increased in response to an increase in grade. Similarly, the transitions between lift commands, (transitions among increasing lift, decreasing lift, and holding lift commands) may be adjusted based on the track grade. Further still, the lift command may be adjusted based on whether the locomotive is in a start condition, non-start condition, or restart condition.

In addition, the amount of lift may be further adjusted, for example, limited, in response to conditions external to the vehicle, including environmental and weather conditions, such as an ambient temperature, pressure, humidity, and weather. For example, in response to a weather condition, a controller may further limit the determined amount of lift. In one example, during higher ambient temperatures, the amount of lift may be limited to lower amounts to reduce heat stress on the wheels. In another example, then amount of lift may be further limited in the event of rain and/or snow to reduce vehicle slide. As such, when an amount of lift is to be increased or decreased, the controller may also determine a corresponding ramp-up rate or ramp-down rate, respectively. The ramp-up and/or ramp down rates may be based on parameters including, a level of lifting, a vehicle speed, and a tractive effort.

Figure 9:
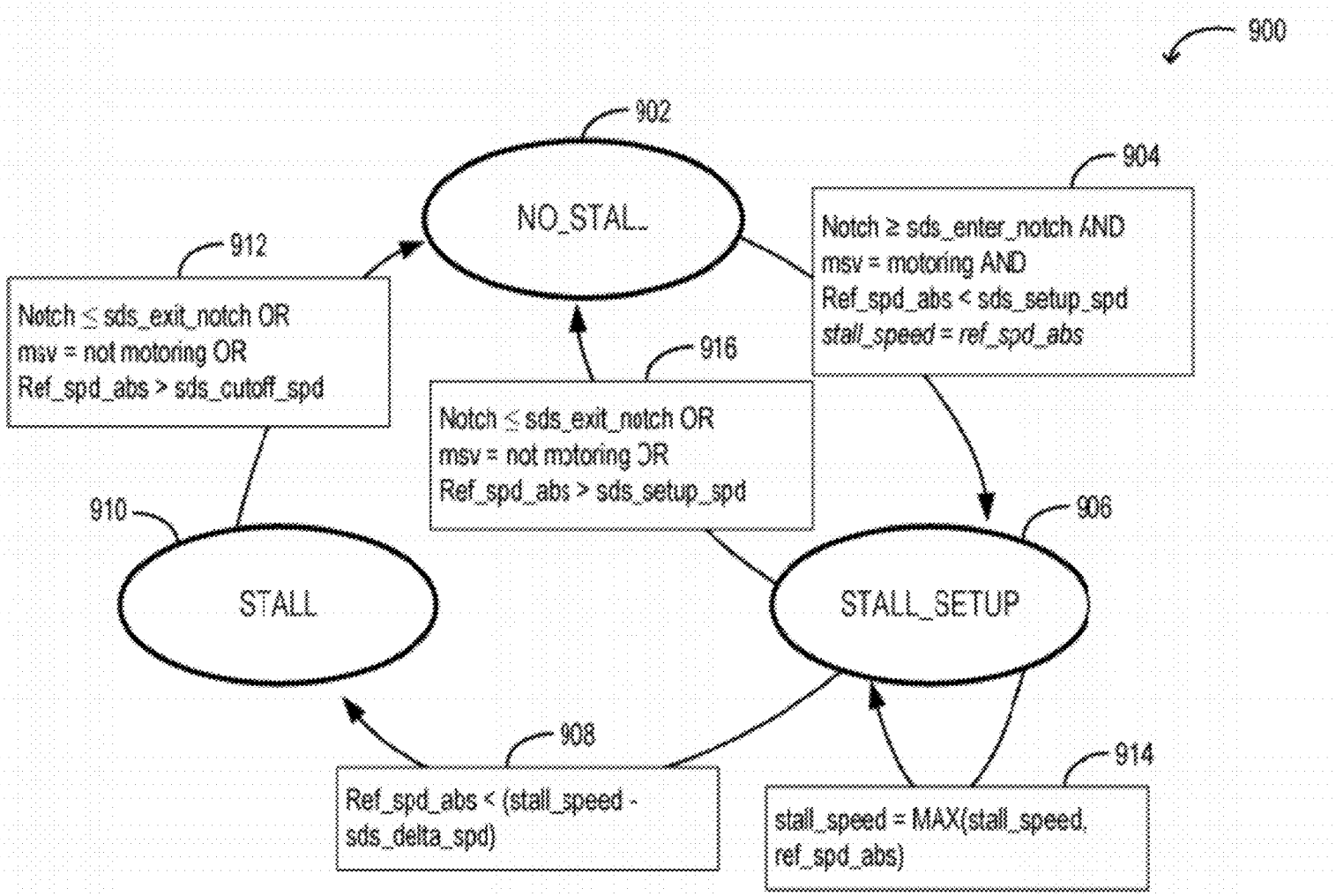
FIG. 9 shows a state diagram for identifying a stall condition in the vehicle lift mechanism.

Now turning to FIG. 9, an example state diagram 900 is depicted to identify potential vehicle stall, for example as may be used by the lift selection algorithm (of FIG. 8) to calculate the lift command. The state diagram 900 determines a stall state of the locomotive. As such, the locomotive may be in one of three stall states including a state of no stall (no_stall 902), a state of stall 910 and a state of potential stall (stall_setup 906).

Following a powering up of the locomotive, the locomotive may initially be in the state of no_stall 902. From here, the locomotive may only be transitioned to a state of stall_setup 906 wherein it may be determined whether there is an imminent stall risk or not. The locomotive may enter stall_setup 906 from no_stall 902 in response to conditions 904 including, the locomotive notch being above a threshold value (sds_enter_notch), for example, above notch 8, the locomotive being in a motoring condition, and the locomotive speed being below a threshold speed (sds_setup_spd), for example, below 11 mph. Additionally, a controller may note the speed at which the locomotive enters the stall_setup state (stall_speed). The locomotive may return from stall_setup 906 to no_stall 902 in response to conditions 916 including, the locomotive notch being below a threshold value (sds_exit_notch), for example, below notch 5, the locomotive being in a non-motoring condition, or the locomotive speed being above a threshold speed (sds_setup_spd), for example, above 11 mph.

The locomotive may enter stall 910 from stall_setup 906 in response to conditions 908 including the locomotive speed falling below the stall speed (stall_speed) by a threshold amount (sds_delta_spd), for example, falling by 2 mph. As such, while waiting for the speed to drop, the locomotive may be maintained in stall_setup 906.

The locomotive may return to no_stall 902 from stall 910 in response to conditions 912 including, the locomotive notch being below a threshold value (sds_exit_notch), for example, below notch 5, the locomotive being in a non-motoring condition, or the locomotive speed being above a threshold speed (sds_cutoff_spd), for example, above 17 mph. In this way, during conditions of low speed and high notch, when the locomotive is motoring, a controller may predict a vehicle stall and adjust the lift operation accordingly.

It will be appreciated that a variety of lift commands may be possible, based on the vehicle operating conditions, to thereby adjust a vehicle lift mechanism. In one example, the adjustment may include, during a first operating condition, increasing a determined amount of lift, maintaining the determined amount of lift during a second operating condition, and decreasing the determined amount of lift during a third operating condition. In a second example, the adjustment may include, during a first vehicle operational range, maintaining the determined amount of lift in response to increased wheel slippage, and during a second vehicle operational range, increasing the determined amount of lift in response to increased wheel slippage. In this way, lift commands may be dynamically adjusted responsive to vehicle operating conditions. By adjusting the lift commands dynamically, the lift mechanism of the vehicle may be adjusted to thereby enable the dynamic weight redistribution. By performing adjustments to the lift operation to compensate for vehicle slip, sanding interactions, truck conditions, track gradients, etc., potential locomotive damage may be substantially reduced.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims. Moreover, unless specifically stated otherwise, any use of the terms first, second, etc., do not denote any order or importance, but rather the terms first, second, etc. are used to distinguish one element from another.

The invention claimed is:

1. A method for a vehicle having a plurality of axles and a lift mechanism configured to dynamically transfer weight from one axle to another, the method comprising:

responding to an operating condition by adjusting the lift mechanism to provide a determined amount of lift; and in response to vehicle braking, reducing the determined amount of lift, wherein the determined amount of lift is limited to lower amounts as a vehicle speed increases.

2. The method of claim 1, wherein reducing the determined amount of lift includes providing no lift.

3. The method of claim 2, wherein providing no lift includes opening a dump valve of the lift mechanism.

4. The method of claim 1, wherein adjusting the lift mechanism includes increasing the determined amount of lift during a first operating condition, maintaining the determined amount of lift during a second operating condition, and decreasing the determined amount of lift during a third operating condition.

5. The method of claim 4, wherein transitions between lift commands are adjusted based at least on a track grade.

6. The method of claim 5, wherein the track grade is determined based on any one or more of a locomotive tractive effort, a locomotive speed history, track database information, and a global positioning system information.

7. The method of claim 1, wherein the determined amount of lift is based on any one or more of axle tractive efforts, fuel level, wheel diameter, track grade, sanding interactions, friction braking forces, and determined static axle weights.

8. A method for a vehicle having a plurality of axles and a lift mechanism configured to dynamically transfer weight from one axle to another, the method comprising:

responding to an operating condition by adjusting the lift mechanism to provide a determined amount of lift; and in response to vehicle braking, reducing the determined amount of lift, wherein adjusting the lift mechanism includes, during a first operating condition, opening a first dump valve to reduce lift, and during a second operating condition, opening a second regulator valve to reduce lift, wherein the first dump valve allows for a more rapid lift reduction than the second regulator valve.

9. A method for a vehicle having a plurality of axles and a lift mechanism configured to dynamically transfer weight from one axle to another, the method comprising:

responding to an operating condition by adjusting the lift mechanism to provide a determined amount of lift; and in response to vehicle braking, reducing the determined amount of lift, wherein reducing lift includes ramping down the determined amount of lift at a ramp-down rate, the ramp-down rate based on a level of lifting, a vehicle speed, and/or a vehicle tractive effort.

10. A method for a vehicle having a plurality of axles and a lift mechanism configured to dynamically transfer weight from one axle to another, the method comprising:

responding to an operating condition by adjusting the lift mechanism to provide a determined amount of lift; and in response to identification of a vehicle stall risk, increasing the determined amount of lift, wherein the vehicle stall risk is identified based on a vehicle speed decrease under selected wheel slipping conditions, and wherein the determined amount of lift is increased as wheel slip related tractive effort reductions increase.

11. A method for a vehicle having a plurality of axles and a lift mechanism configured to dynamically transfer weight from one axle to another, the method comprising:

responding to an operating condition by adjusting the lift mechanism to provide a determined amount of lift; and in response to identification of a vehicle stall risk, increasing the determined amount of lift, wherein increasing the determined amount of lift in response to the vehicle stall risk includes, performing a manual or automatic sand application to increase the tractive effort, and if a desired tractive effort is not produced, increasing the determined amount of lift.

12. A method for a vehicle having a plurality of axles and a lift mechanism configured to dynamically transfer weight from one axle to another, the method comprising:

responding to an operating condition by adjusting the lift mechanism to provide a determined amount of lift; and in response to identification of a vehicle stall risk, increasing the determined amount of lift, wherein during the vehicle stall risk, the determined amount of lift is provided before an automatic sand application to reduce sand use.

13. A method for a vehicle having a plurality of axles and a lift mechanism configured to dynamically transfer weight from one axle to another, the method comprising:

responding to an operating condition by adjusting the lift mechanism to provide a determined amount of lift; and in response to an infrastructure condition, reducing the determined amount of lift, wherein the infrastructure condition includes one of a reduced track quality, a reduced bridge stability, a reduced ballast quality, and a reduced tie quality.

14. The method of claim 13, wherein the infrastructure condition is determined from a track database and/or a global positioning system.

15. The method of claim 13, wherein the infrastructure condition is manually input.

16. A method for a vehicle having a plurality of axles and a lift mechanism configured to dynamically transfer weight from one axle to another, the method comprising:

responding to an operating condition by adjusting the lift mechanism to provide a determined amount of lift;

in response to an infrastructure condition, reducing the determined amount of lift; and in response to a weather condition, further limiting the determined amount of lift.

17. A vehicle system, comprising:

a truck with a plurality of axles and a lift mechanism configured to dynamically transfer weight from one axle to another; and a control system with a computer readable storage medium and instructions for, responding to an operating condition by adjusting the lift mechanism to provide a determined amount of lift;

determining a vehicle penalty based at least on lift mechanism component stress, locomotive component stress, wheel slip, vehicle stall risk, fuel level, and lift mechanism actuator forces; and limiting the determined amount of lift based on the determined vehicle penalty.

18. The vehicle system of claim 17, wherein the limiting includes reducing the determined amount of lift as the determined vehicle penalty increases.

19. The vehicle system of claim 17, wherein the determined amount of lift is further limited based on infrastructure and/or weather conditions.

* * * * *